United States Patent [19]

Frederiksen

[11] 4,427,171

[45] Jan. 24, 1984

[54] MOUNTING BRACKET FOR USE IN INSTALLING BEAM-LIKE CHANNEL MEMBERS UNDER HORIZONTAL SURFACES, IN PARTICULAR CEILINGS

[76] Inventor: Jørgen O. Frederiksen, Gasvaerksvej 16, 6580 Vandrup, Denmark

[21] Appl. No.: 330,907

[22] Filed: Dec. 15, 1981

[30] Foreign Application Priority Data

Dec. 16, 1980 [DK] Denmark ..... 5345/80

[51] Int. Cl.[3] ..... F16L 3/22

[52] U.S. Cl. ..... 248/68 R; 52/DIG. 8; 248/317

[58] Field of Search ..... 248/68 R, 65, 317, 216.1, 248/222.4, 228, 343, 251, 254, 262, 264; 52/DIG. 8, 714, 512

[56] References Cited

U.S. PATENT DOCUMENTS

| | | | |
|---|---|---|---|
| 2,898,075 | 8/1959 | McGinty | 248/343 |
| 2,916,246 | 12/1959 | Radel | 248/264 |
| 3,342,006 | 9/1967 | Joseph et al. | 52/DIG. 8 |
| 3,387,872 | 6/1968 | Lovullo et al. | 52/DIG. 8 |
| 4,224,974 | 9/1980 | Anderson et al. | 248/221.4 |
| 4,265,423 | 5/1981 | Vecchiarelli | 248/264 |

*Primary Examiner*—William H. Schultz
*Assistant Examiner*—Ramon O. Ramirez
*Attorney, Agent, or Firm*—Becker & Becker, Inc.

[57] ABSTRACT

A mounting bracket for use in installing beam-like channel members under ceilings and the like. The bracket includes a substantially rectangular base having four perpendicularly bent sidepieces. The mounting bracket is fastened to an existing ceiling by means of a screw running through an opening in the upper perpendicularly bent sidepiece and fastened to a flap of the mounting bracket by means of a clasp nut and a counter nut around the flap, which extends perpendicularly from the base and has an opening for passing through the screw thread. The other perpendicularly bent sidepieces are provided with substantially 8-shaped openings for releasable receipt of screw heads of wood screws screwed into wooden sheets in such a manner that they extend slightly from the surfaces of the wooden sheets. Via this mounting bracket it is possible to install beam-like channel members under an existing ceiling, with the removable side walls of the channel members rendering it possible to inspect and repair technical installations, if any, in the channels enclosed in the wooden sheets.

6 Claims, 2 Drawing Figures

Figure 1:
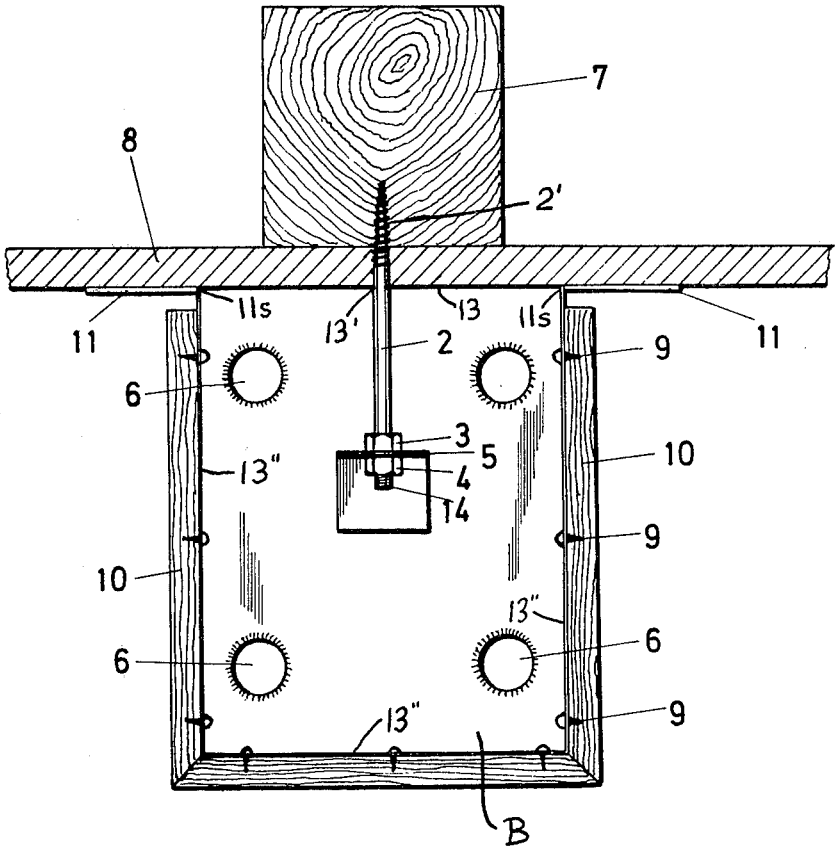

MOUNTING BRACKET FOR USE IN INSTALLING BEAM-LIKE CHANNEL MEMBERS UNDER HORIZONTAL SURFACES, IN PARTICULAR CEILINGS

The invention relates to a mounting bracket for use in installing beam-like channel members under horizontal surfaces, in particular ceilings.

In new building, and in modernizing existing buildings architects often wish to be able to give the rooms a certain character by placing wooden beams extending downwardly from the very ceiling surface and thus being visible. In the first place solid natural timbers are relatively expensive and in the second place so heavy that often existing brickwork will not be dimensioned so as to be capable of carrying this extra load. For these reasons the solution of placing solid wooden timbers under the ceiling surface must in many cases be rejected.

Thus, a construction is required which on the outside has the appearance of a natural beam, but which is actually built up of three thin sheets forming the sides of a channel running under the ceiling.

Hitherto, such constructions have been designed as more or less complicated assemblies comprising a wooden latticework onto which the above-mentioned sheets are fastened with nails or screws. It is time-consuming to mount such constructions, and the nailheads or screwheads will be visible, if time is not spent on countersinking these and on covering the countersunk heads with artificial wood or the like.

The purpose of the invention is to provide a mounting bracket which may be installed directly under an existing ceiling by means of a simple hand tool and which may form carrying units for the support of relatively thin sheets making up the sides of the "ceiling beams".

According to the invention, this purpose is achieved by means of a mounting bracket of the type mentioned in the introduction and characterized in that it comprises a substantially rectangular base having four perpendicularly bent sidepieces, one of them having at least one opening for receiving an anchor member designed to be screwed into the ceiling, while the remaining three sidepieces are designed with openings for receiving the free ends or heads of screws, nails or similar fastening means.

By means of this simple mounting bracket it is possible to provide an anchoring to the ceiling by screwing in an anchor member known per se, e.g. a so-called coach screw, and the three bent sides of the mounting bracket may form supporting surfaces for the relatively thin wooden sheets, as wooden screws may be screwed into the wooden sheets, the heads of said screws extending a distance from the surface of the wooden sheets and being designed to be received in the abovementioned openings of the bent sidepieces of the mounting bracket.

In a preferred embodiment of a mounting bracket according to the invention the anchor member is in the form of a an elongated screw member having a wood screw thread at one end and a machine screw thread at the other end.

By using such an anchor member a secure fastening of the mounting bracket in the ceiling may be achieved, as the wood screw is mainly screwed into a prebored hole in a beam forming part of the existing horizontal division. The screw thread at the other end of the screw member may be used for receiving a clasp nut and a counter nut for providing a safe and vibration-free fastening of the anchor member.

According to the invention, a flap may be cut in the rectangular base, said flap extending perpendicularly from the base and being provided with a bore hole corresponding to the diameter of the screw member.

The flap cut out of the base may be used for fastening the screw member on the mounting bracket, as a clasp nut is mounted on the part of the screw member lying below the flap and a counter nut is mounted on the part of the screw member lying above the flap. By using a flap lying some distance below the upper sidepiece of the mounting bracket, it is easier to tighten the two nuts compared to the case situation where the nuts were placed directly under the upper sidepiece of the mounting bracket.

In a preferred embodiment, the openings for receiving the free screw ends are substantially 8-shaped comprising a first opening having a relatively large diameter and an adjacent second opening having a somewhat smaller diameter.

By using openings formed in this manner in the sidepieces of the mounting bracket, there is achieved a very simple placing of the sheet pieces serving as beam walls, as the screw heads extending from the insides of the wooden sheets may be led into the largest opening and be pushed down into the somewhat smaller opening providing a practically sufficiently safe securing of the sheet pieces on the sidepieces of the mounting brackets arranged successively lengthwise of the beam.

According to the invention, a number of circular openings may be formed in the base for passing through pipes and/or conduits.

This measure is appropriate as the installations led through the holes are rendered available for inspection and repair by simply removing the wooden sheets fastened releasably to the mounting brackets.

In another preferred embodiment of a mounting bracket according to the invention, slots are provided for receiving the stems of substantially T-shaped supporting sheets.

Hereby the mounting brackets may be used for securing the ceiling sheets or ceiling panels in place, as these will be able to rest on the above-mentioned supporting sheets carried by the mounting brackets.

Figure 2:
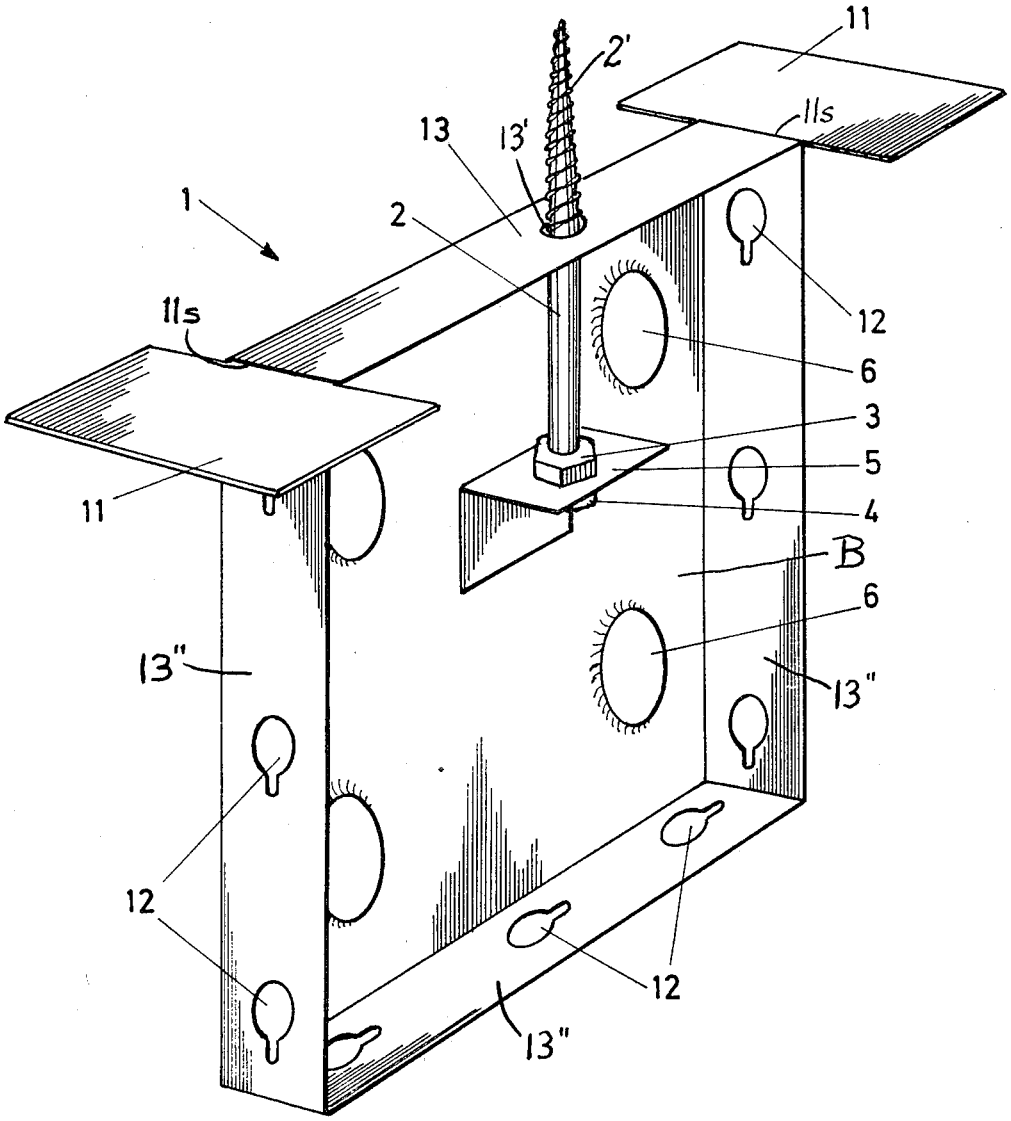

In the following, the invention will be further explained with reference to the drawing, in which FIG. 1 shows a mounting bracket according to the invention fastened to an existing beam and provided with wooden side walls, and FIG. 2 shows a mounting bracket formed in accordance with the invention.

In FIG. 2 of the drawing, the mounting bracket as such is indicated by reference number 1. As shown in FIG. 1 a wood screw 2 is screwed into a beam 7 through the upper bent sidepiece 13 of the mounting bracket. At its free end the wood screw 2 is provided with both a wood screw 2' and also a machine screw thread 14 running on both sides of a flap 5 extending perpendicularly from the base of the mounting bracket. On both sides of the flap 5 nuts 3 and 4 are placed serving as counter nut and clasp nut, respectively. Through openings 12 formed in the perpendicularly bent sidepieces 13 of the mounting bracket screwheads are placed belonging to screws 9 screwed into wooden sheets 10 and in such a manner that the screwheads extend slightly from the surfaces of the wooden sheets 10. Thus, in the embodiment shown in the drawing, the mounting bracket 1 is placed under an existing ceiling 8 supported by a number of beams 7.

It should be noted that a total of four substantially circular holes 6 are formed in a rectangular base B of the mounting bracket, said holes being applicable in mounting electric installations or the like and at the same time strengthening the sheet.

FIG. 2 is an enlarged front view of a mounting bracket designed according to the invention. From this figure it appears more clearly that substantially 8-shaped openings 12 in the sidepieces of the mounting bracket may be used for receiving the heads of the screws 9. Hereby a releasable fastening of the wooden sheets 10 on the mounting bracket 1 may be provided in a simple manner.

Moreover, it appears from FIG. 2 that substantially T-shaped supporting sheets 11 may be placed in slots 11s positioned between the upper bent sidepiece 13 and the also bent sidepieces 13″ lying thereunder.

The invention is not limited to exactly the features shown and described, and it should particularly be noted that, if necessary, more than one anchor member 2 may be employed for fastening the mounting bracket in an existing ceiling, and moreover, it is not necessary, either, that the mounting bracket be fastened in existing beams.

What I claim is:

1. A mounting bracket for use in installing a beam-like channel member under and to a horizontal surface, particularly a ceiling, said channel member being provided with fastening means which have free ends extending from said channel member for use in fastening the latter to said mounting bracket, said mounting bracket comprising:

a shallow open box having a substantially rectangular base and four sidepieces connected thereto and extending perpendicularly from the same side thereof; and at least one anchor member attached to said mounting bracket and designed to be screwed into said horizontal surface, one of said sidepieces having at least one opening for respectively receiving an anchor member therethrough, and the other three sidepieces being respectively provided with a plurality of openings for receiving said free ends of said fastening means of said channel member to effect fastening thereof to said mounting bracket.

2. A mounting bracket according to claim 1, in which said anchor member is an elongated screw member having a wood screw thread at one end, and a machine screw thread at the other end, said latter end being attached to said mounting bracket.

3. A mounting bracket according to claim 2, which includes a flap cut out of and attached to said rectangular base, said flap extending perpendicularly from the same side of said base as do said sidepieces, said flap being substantially parallel to that sidepiece which is provided with said at least one opening for an anchor member, said flap further being provided with a bore hole corresponding to the diameter of said screw member for effecting said connection of said screw member to said mounting bracket.

4. A mounting bracket according to claim 1, in which said openings for receiving said free ends of said fastening means are substantially 8-shaped, and have a first opening having a relatively large diameter, and a second opening having a somewhat smaller diameter and communicating with said first opening.

5. A mounting bracket according to claim 1, in which said base is provided with a number of circular openings to allow pipes and/or conduits to pass through.

6. A mounting bracket according to claim 1, which is provided with slots for receiving the stems of mainly T-shaped supporting sheets.

* * * * *